US005769734A

United States Patent [19]

Qualey, Sr.

[11] Patent Number: 5,769,734

[45] Date of Patent: Jun. 23, 1998

[54] GOLF SWING TRAINING DEVICE

[76] Inventor: Royal Ellis Qualey, Sr., 2713 Russell Rd., Centralia, Wash. 98531

[21] Appl. No.: 763,131

[22] Filed: Dec. 13, 1996

[51] Int. Cl.[6] ..... A63B 69/36; A63B 15/00

[52] U.S. Cl. ..... 473/233; 473/253; 482/109; 482/121

[58] Field of Search ..... 473/219, 232, 473/233, 234, 253; 482/109, 110, 121

[56] References Cited

U.S. PATENT DOCUMENTS

| | | | |
|---|---|---|---|
| 2,482,015 | 9/1949 | McConnell . | |
| 3,428,325 | 2/1969 | Atkinson . | |
| 3,716,239 | 2/1973 | Goudreau . | |
| 4,045,034 | 8/1977 | Thomas . | |
| 4,302,008 | 11/1981 | Lard . | |
| 4,541,631 | 9/1985 | Sasse . | |
| 4,588,191 | 5/1986 | Stewart . | |
| 4,809,975 | 3/1989 | Lee . | |
| 5,121,925 | 6/1992 | Blundo . | |
| 5,405,139 | 4/1995 | Gagarin | 473/232 |

FOREIGN PATENT DOCUMENTS

WO 93/03798 3/1993 WIPO .

*Primary Examiner*—George J. Marlo
*Attorney, Agent, or Firm*—Brian J. Coyne

[57] ABSTRACT

A golf swing training device for attachment to a golf club. A bell-shaped weight having an axial bore and a slot that communicates with the bore is slidably mountable to the shaft of a golf club. The weight is attached to and suspended from an elastic, expansible cord. The cord is attached to an eyelet inserted into a recess in a top surface of the golf grip. A cord guard comprising a segment of tubing surrounds and protects the cord. The weight has inner and outer pairs of holes disposed on opposite sides of the bore through which opposite ends of the cord are threaded to reversibly attach the weight to the cord. During a downswing of the club, the weight slides under centrifugal force along the shaft toward the golf club head, which the golfer experiences as progressively increasing resistive force. The degree of resistive force is easily and rapidly adjustable by varying the length of cord between the eyelet and the weight when the club is at rest.

10 Claims, 6 Drawing Sheets

GOLF SWING TRAINING DEVICE

BACKGROUND OF THE INVENTION

1. Field of the Invention

The present invention relates to the field of training devices for improving the accuracy and power of a golf swing, especially golf swing training and muscle exercising devices for attachment to a golf club that include a sliding weight suspended from the golf club shaft by an elastic, extensible cord.

2. Background Art

A proper golf club swing begins with a back swing, during which the wrists of both hands are progressively cocked back as the club head is raised to a position above and behind the head of the golfer, and includes a back wrist break that preferably commences as the golf club shaft is raised through a position parallel to the ground. The back swing is followed by a downswing, during the "power zone" portion of which the wrists of both hands are progressively bent forward, the forward wrist break commencing from when the golf club shaft has been lowered parallel to the ground, and continuing thereafter through the point of impact with a golf ball. During the ensuing follow-through portion of the swing, the wrists continue to bend forward. To develop a correctly oriented golf swing free of slicing and other defects, it is critical that the golfer be able to sense when he is progressing through the power zone, and that his forward wrist break be synchronized therewith. Furthermore, to develop a powerful golf swing it is important to exercise the muscles of the hands, wrists, arms and upper torso that are instrumental in executing a correctly oriented golf swing in such a way as to develop a kinesthetic memory thereof. This can best be accomplished by repeatedly practicing a correct golf swing as herein described against a resistive force, which resistive force appears and progressively increases as the golf swing moves through the power zone, thereby providing instantaneous and continuous kinesthetic feedback to the golfer during that critical portion of the downswing.

Weighted attachments for golf clubs such as those disclosed by Stewart, U.S. Pat. No. 4,588,191, Thomas, U.S. Pat. No. 4,045,034, and Goudreau, U.S. Pat. No. 3,716,239, provide a weight removably attachable to a fixed position on a golf club shaft. Such weighted attachments, however, give the downswing an unnatural feel and do not provide the desired progressively increasing resistance through the power zone with resulting kinesthetic feedback.

McConnell, U.S. Pat. No. 2,482,05, disclosed an attachment to a golf club for swing practice comprising a flexible band member partially wound on a spring-loaded reel within a housing and having a free end attached to a weight such as metal ball. With the housing attached to an upper portion of a golf club shaft, swinging of a golf club with the attachment was intended to assist in teaching a proper golf swing. Although McConnell's attachment retained the sensory advantage of training and exercising with an actual golf club and provided some increasing resistive force through the power zone portion of the downswing as well, the tendency of the band and weight to bob around rendered it mechanically unstable.

Prior to my invention, there existed several golf swing training devices that incorporated a weight and an elastic extensible member attached to a shaft, which provided resistive force during a downswing. Atkinson, U.S. Pat. No. 3,428,325, disclosed a golf swing training club comprising a golf club handle, a soft rubber weight, and an elastic, extensible cord having one end attached to the weight and an opposite end attached to the handle. During a downswing of the club, the centrifugal force applied to the weight caused the cord to stretch up to one hundred percent of its initial length, thereby providing a progressively resistive force during the downswing. Atkinson's training club was not a true golf club and it employed a laterally flexible cord, which did not provide the sensory feel and dynamic action of a true golf club; moreover, it afforded no means for adjusting the resistive force.

Hanton, PCT No. W009300378A, disclosed a golf trainer having a shaft, a golf grip attached to an upper portion of the shaft, a weight, and a length of elastic, extensible shock cord having one end attached to the weight and an opposite end attached to the shaft. In one version of Hanton's golf trainer, the shock cord extended through a length of flexible hose attached to the shaft and within which the weight could travel. No provision was made for facilitating adjustment of the resistive force.

Lee, U.S. Pat. No. 4,809,975, disclosed a shaft having a golf grip attached at an upper end and a stop formed at a lower end thereof. A weight was slidably mounted on the shaft, and a coil spring was mounted between the weight and the stop.

Sasse, U.S. Pat. No. 4,541,631, disclosed a golf club having a hollowed head portion connected to a hollow shaft portion forming a sealed, internal chamber within the club. During a downswing, a flowable weight within the chamber flowed by centrifugal force from the hollow shaft into the hollowed head portion, thereby providing resistive force during a downswing.

The devices of Atkinson, Hanton, Lee and Sasse, not being true golf clubs, had an unnatural feel; moreover, none made provision for adjusting the resistive force.

There remains, therefore, a need for a device for attachment to a golf club that provides a natural feeling golf grip and golf swing and a progressively increasing resistive force during the power zone portion of a downswing with perceptible kinesthetic feedback, and that permits rapid and convenient adjustment of the resistive force.

SUMMARY OF THE INVENTION

According to the invention, there is provided a device for attachment to a golf club that includes a weight having a central bore for sliding movement along the shaft of a golf club, and an elastic, extensible cord for suspending the weight from a top portion of the shaft, whereby a progressively increasing resistive force is provided during the power zone portion of a golf swing. The weight has a shaft-receiving groove that communicates with the bore, thereby facilitating reversible mounting of the weight to the shaft. The device further includes an eyelet for insertion into a recess in a top surface of the grip of the golf club, the cord being inserted through the eyelet and having first and second weight support portions suspended from the eyelet. The weight has an inner pair of holes and an outer pair of holes disposed on opposite sides of an axis through the bore, whereby the cord is attached to the weight by inserting each end of the cord down through an inner hole and then looping said end upward through an adjacent outer hole, thereby creating a loop, and thereafter back down and through the loop. Accordingly, the effective extensible length of the cord, and likewise the resistive force provided by the device in the power zone, can be easily and rapidly adjusted by feeding more or less of the first and second weight support portions of the cord through the respective inner and outer holes in the manner described.

In a first embodiment, the device further includes an arcuate cord guard comprising a segment of tubing inserted through the eyelet and arched on either side thereof and extending part way down toward the golf club head, encompassing and protecting the cord. The user grasps the golf grip by placing his hands between the downwardly arching portions of the arcuate guard support.

In a second embodiment, the device alternately includes a linear cord guard comprising a straight segment of tubing for placement adjacent a forward surface of the shaft and extends from near the eyelet to a mid portion of the shaft, and both ends of the cord are drawn therethrough and attached to the weight. The user grasps the golf grip by placing his hands around the linear cord guard.

The weights should be in the ranges 6 to 16 ounces, 5 to 8 ounces, and 3 to 5 ounces, for use by men, women and children, respectively.

The device thereby attains the following objects:

A resistive force is provided during the power zone portion of a golf swing, which provides sensory feedback to enhance kinesthetic memory of a proper golf swing, and further provides exercise of the relevant muscles.

The resistive force provided is easily and rapidly adjustable by adjusting the length of the elastic, expansible cord.

The device can be easily mounted to, and dismounted from, any golf club.

Since the device is used with an actual golf club, it provides the true feel of a golf club and golf club swing.

The device provides effective golf swing training and exercise while hitting golf balls as well as when not hitting golf balls.

DETAILED DESCRIPTION OF THE INVENTION

Figure 1:
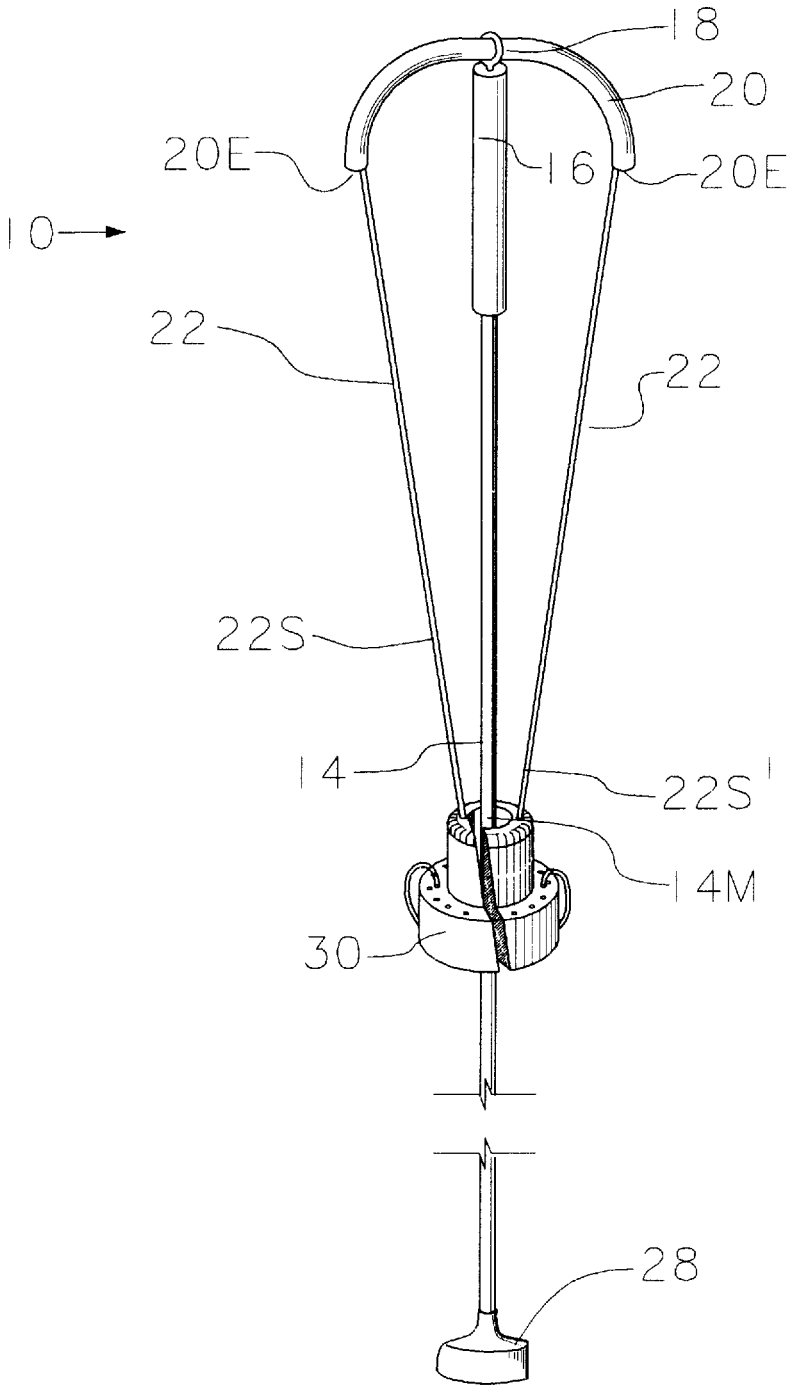
FIG. 1 is a frontal perspective view of a golf club at rest with a first embodiment of my device mounted thereon and ready for use.

Referring to FIG. 1, a first embodiment of my device, denoted generally by the numeral 10, is shown mounted on a golf club 12. The golf club 12, here depicted as a wood but which may be any of the irons or woods commonly used by golfers, is of conventional construction, and includes a shaft 14, a golf grip 16 in the form of a rubber sheath that surrounds an upper portion of the shaft 14, and a golf club head 28 attached to a lower end of the shaft 14. Such clubs each come equipped with a vertical recess (not shown) that is bored into a top surface of the grip 16, and into said recess is inserted an eyelet 18 when it is desired to mount my device for golf swing training and exercise. The eyelet 18 is preferably made of brass or other corrosion-resistant material, with a one inch threaded shank portion and a circular eye portion of ¾ inch outer diameter and ⅜ inch inner diameter. Inserted through the eyelet 18 is an arcuate cord guard 20 consisting of a segment of tubing, preferably polyvinyl plastic tubing having length 10.5 inches, 1.6 inch outer diameter and 5/16 inch inner diameter. Inserted through the lumen of the arcuate cord guard 20 is an elastic, expansible cord 22, for example, a bungee cord, such that a midpoint along the length of the cord 22 is adjacent a midpoint along the length of the guard 20. The cord 22 is preferably 55 inches long and ⅛ inch diameter, more or less. A weight 30 is shown mounted to a mid portion 14M of the shaft 14 and attached to, and suspended from, opposite first and second weight support portions 22S, 22S' of the cord 22, thereby causing opposite ends 20E of the cord guard 20 to be bent downward from the eyelet 18 toward said mid portion 14M of the shaft 14.

Figure 2:
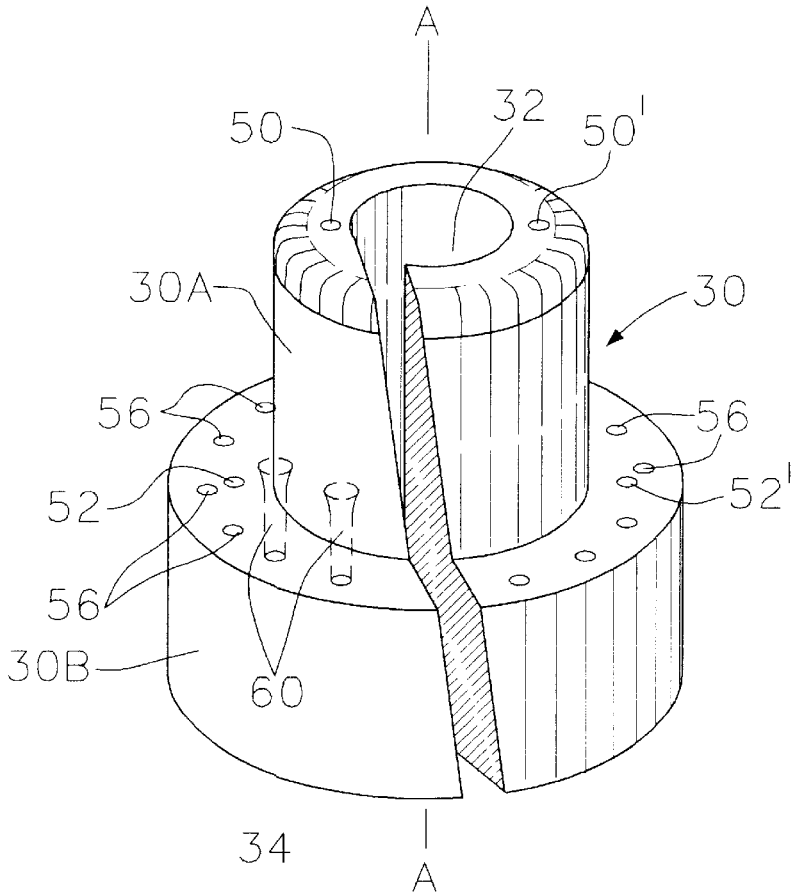
FIG. 2 is an enlarged, frontal perspective view of the weight of said device.

Referring to FIG. 2, the weight 30, disattached both from the shaft 14 and from the cord 22, is shown in enlarged perspective view. The weight 30 has a generally bell-shaped exterior surface radially formed about an axis A—A, and has an upper dome portion 30A and integral and coaxial therewith an enlarged diameter lower disk portion 30B. The weight 30 preferably has a plurality of holes 56 distributed around an upper surface of the disk portion 30B thereof as shown, which holes provide convenient storage space for golf tees 60.

Figure 3:
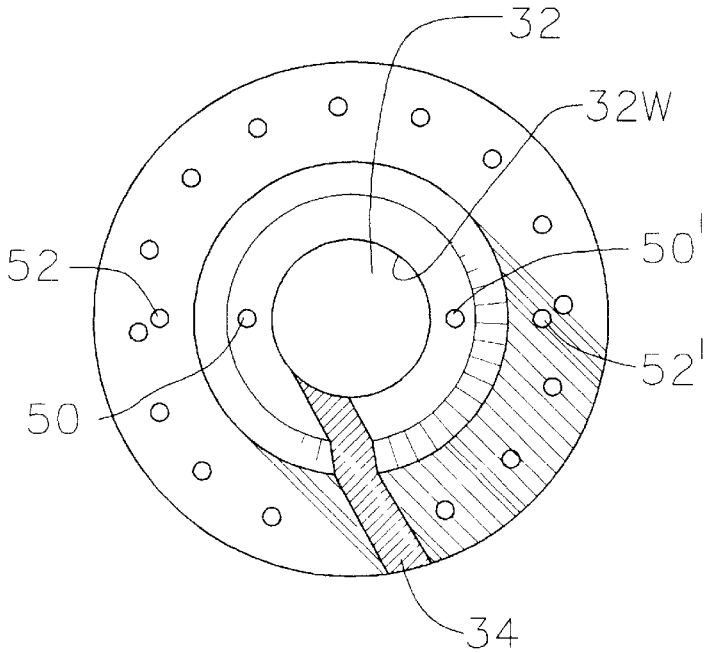
FIG. 3 is a top plan view of the weight.
Figure 4:
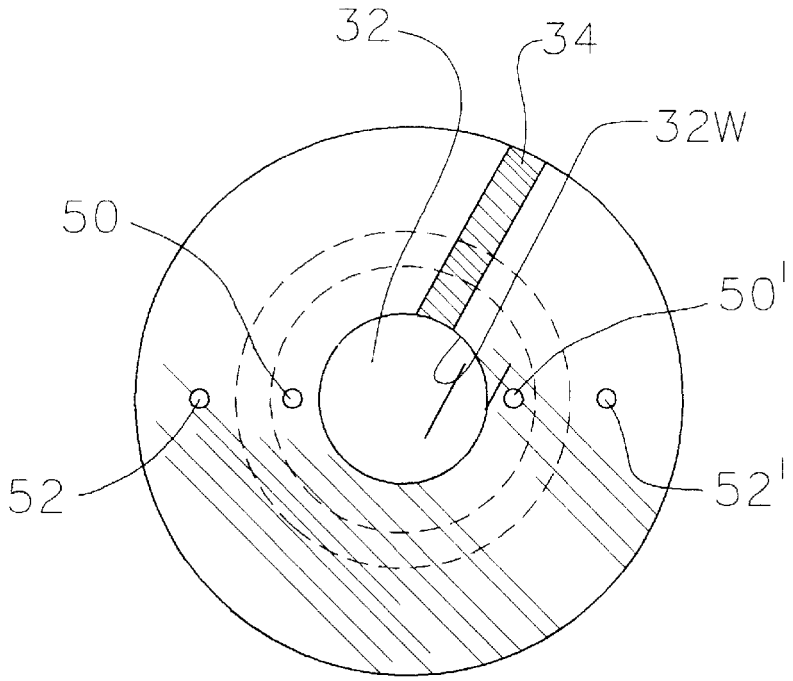
FIG. 4 is bottom plan view of the weight.

The weight 30 has an axial bore 32 for receiving the shaft 14 of a golf club 12 and for permitting smooth sliding motion thereon. Communicating with the bore 32 is a slot 34 extending from the bore 32 to the periphery of the weight 30. Referring to FIGS. 3 and 4, which show the weight 30 in top and bottom plan views, respectively, the slot 34 is preferably oriented eccentrically and tangentially to an interior wall 32W of the bore 32. The slot 34 has width less than the minimum diameter of the shaft 14—one-half thereof, for example—so as to further minimize the risk of the weight 30 being inadvertently dislodged from the shaft 14. Moreover, as may best be seen in front elevational perspective in FIG. 2, the slot 34 is slanted from top to bottom across the width of the bore 32 to reduce the risk that the weight may become detached from the golf club shaft during an upswing or downswing. The weight 30 is preferably made of composition rubber, such as that commonly used in hockey pucks, or a similar deformable material; accordingly, when the weight 30 is oriented with the slot 34 facing the shaft 14, the slot 34 deforms sufficiently to permit easy mounting of the weight 30 on the shaft 14 by merely pressing the weight 30 towards the shaft 14. Removal of the weight 30 from the shaft 14 is just as easy, and only requires pulling it away from the shaft.

Figure 5:
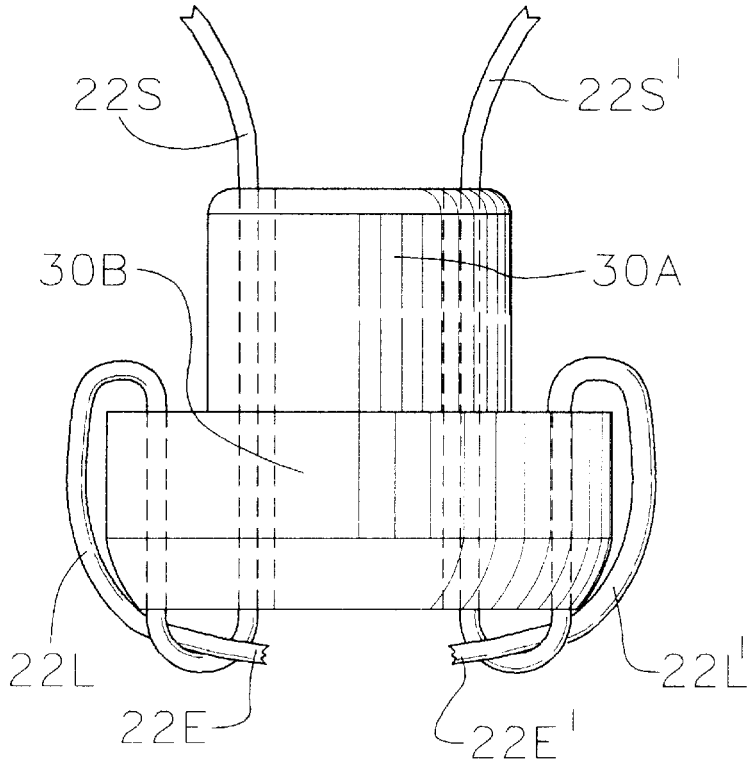
FIG. 5 is a front elevational view of the weight suspended from an elastic, expansible cord, showing opposite ends of the cord threaded through inner and outer pairs of holes vertically bored through the weight.

As FIGS. 3–5 show, the weight 30 has an inner pair of holes 50, 50' disposed on opposite sides of axis A—A and parallel thereto, and extending through the dome portion 30A and the disk portion 30B. Similarly, the weight 30 has an outer pair of holes 52, 52' disposed on opposite sides of axis A—A and parallel thereto, and extending through the disk portion 30B only. As may be best seen in FIG. 5, the purpose of these pairs of holes, 50,50' and 52, 52', is to permit easy and rapid reversible attachment of the weight 30 to the weight support portions 22S, 22S' of the cord 22, and to facilitate adjustment of the distance between the weight 30 and the eyelet 18 when the golf club 12 is at rest—i.e., the shorter the rest length of weight support portions 22S, 22S', the greater the resistive force a golfer will experience during a downswing of the golf club 12. Thus, the cord 22 is shown attached to the weight 30 by insertion of each of the cord ends 22E, 22E'down through an inner hole 50, 50', and then looping said end 22E, 22E' upward through an adjacent outer hole 52, 52', thereby creating a loop 22L, 22L', respectively, and thereafter back down and through the loop.

Figure 6:
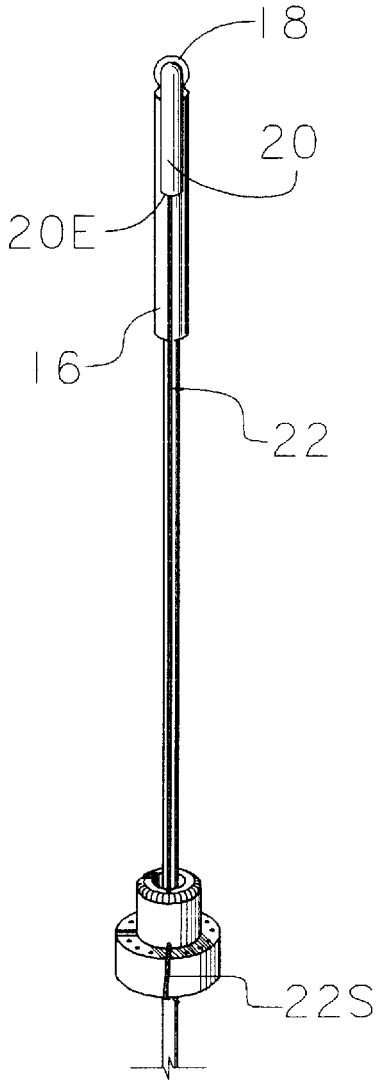
FIG. 6 is a frontal perspective view of a second embodiment of my device mounted to a golf club.
Figure 7:
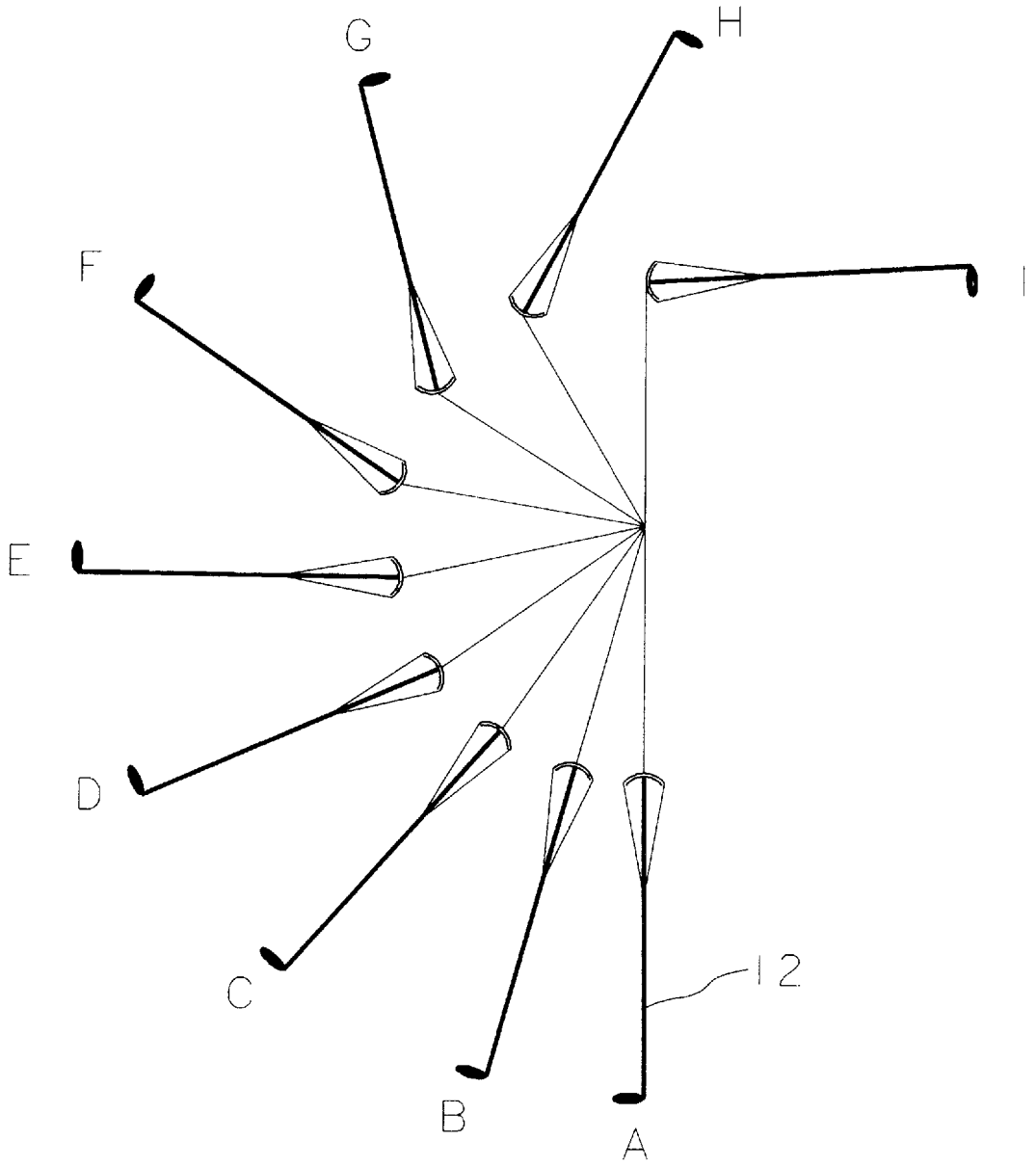
FIG. 7 is a diagram of a back swing of a golf club with my device attached.

In a second embodiment, my device incorporates a linear cord guard 20', as illustrated in FIG. 6, instead of an arcuate cord guard, and has dimensions and composition substantially identical to the dimensions and composition of the arcuate cord guard previously described. The parts that comprise the second embodiment of my device are otherwise identical to those of the first embodiment. As in the first embodiment, an eyelet 18 is placed into a recess in a top surface of the golf grip 16. An elastic, expansible cord 22 is inserted through the eyelet 18 up to a mid point of the cord 22, and the opposite cord ends 22E are together drawn downward along the golf club shaft 14 from the eyelet 18 through the lumen of the linear cord guard 20', which linear cord guard 20' extends along a front surface of the shaft 14 from just below the eyelet 18 to a mid portion of the shaft 14. The cord ends 22E extend through the lower end of the linear cord guard 20' and attach to weight 30 in the manner described for the first embodiment.

Figure 8:
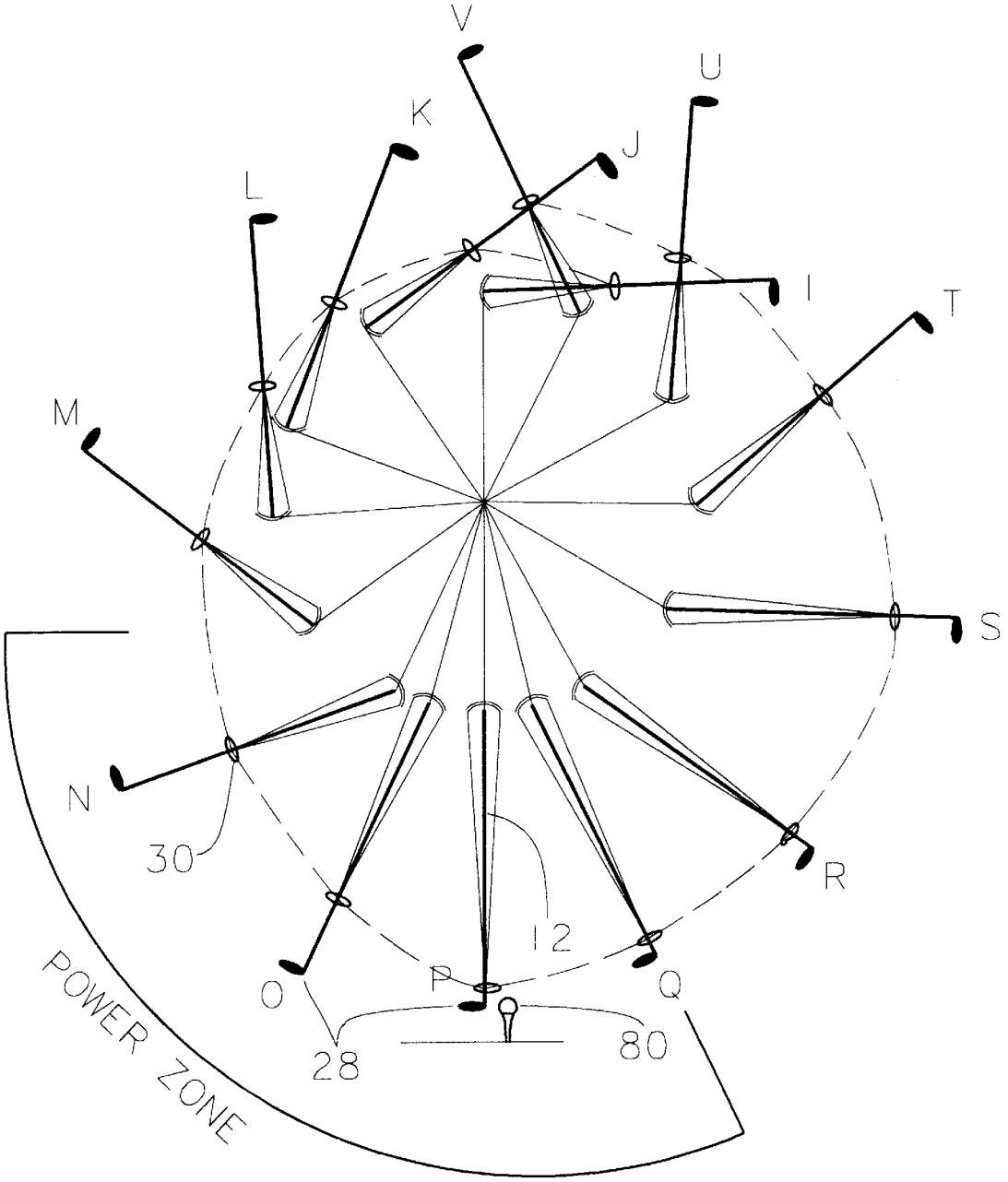
FIG. 8 is a diagram of a downswing and follow-through of a golf club with my device attached, showing the progressive sliding of the weight along the golf club shaft toward the golf club head throughout the power zone (the power zone is shown as corresponding to the reverse movement of the hour hand on a clock face from 9 o'clock to 5 o'clock).

In the case of the first embodiment, after mounting my device to a golf club in the manner described, a golfer places his hands on the grip 16 with his hands between opposite, descending portions of cord 22. In the case of the second embodiment, however, a golfer places his hands around the linear cord guard when he grasps the golf grip 16. In either case, the golfer then proceeds to swing the golf club 12 back as diagrammed through successive positions A through I of the golf club, which imparts little or no translational motion to the weight 30 along the shaft 14. The golfer thereafter proceeds through a downswing, which is diagrammed in FIG. 8 for successive positions I through P (at P, the shaft 14 is vertical), and then on through the follow-through positions Q through V. As may be seen in FIG. 8, the weight 30 slides along the shaft 40 under centrifugal force generated by the downswing toward the golf club head 28, particularly through the power zone, which would correspond to the reverse movement of an hour hand from 9 o'clock to 5 o'clock on a clock face, more or less, and includes positions N, 0 and P. During the downswing, the club head 28 is accelerating at the same time that the cord 22 is being stretched by movement of the weight 30, which the golfer experiences as a progressively increasing resistance to his swing as the golf club 12 moves through the power zone. When the golf club 12 arrives at position P, which would be the point of impact with a golf ball 80, the weight 30 hits the golf club head 28, thereby providing important sensory feedback to the golfer. In this manner, the golfer exercises the relevant muscles while at the same time developing kinesthetic memory for a proper golf swing.

It will be appreciated that various modifications can be made to the exact form of the present invention without departing from the scope thereof. It is accordingly intended that the disclosure be taken as illustrative only and not limiting in scope, and that the scope of the invention be defined by the following claims.

I claim:

1. A golf swing training device for increasing golf club swing resistance during the power zone portion of a golf swing and adapted for attachment to a golf club having a golf head, a shaft and a grip with a recess, comprising:

(a) a weight having a central bore and communicating therewith a shaft-receiving groove having a predetermined width, which groove extends radially from the bore to the periphery of the weight and axially from the top to the bottom thereof, thereby defining apposing, flexible clamp portions of the weight that permit the weight to be mounted on the shaft for reciprocal sliding movement between a mid portion of the shaft and the head without being inadvertently dislodged from the shaft;

(b) an eyelet for insertion into the recess in the grip; and (c) an extensible cord inserted through the eyelet and having first and second weight support portions of equal and adjustably variable length attached to the weight and terminating in first and second ends, respectively; whereby a downward swing of the club forces the weight to slide against resistance of the cord from a mid portion of the shaft along the shaft toward the golf club head, thereby stretching the cord and causing a person swinging the club to experience increased swing resistance primarily during the power zone portion of the swing only.

2. The device of claim 1, wherein the groove extends tangentially and radially outward from the bore and is offset with respect to the axis through the bore.

3. The device of claim 2, wherein the weight has a bell-shaped exterior radially disposed about an axis through the central bore thereof, and comprises a relatively smaller diameter, upper dome portion, and integral and coaxial therewith a relatively larger diameter lower disk portion, and said weight has an inner pair of holes disposed on opposite sides of the axis and extending through the dome portion and the disk portion, and has an outer pair of holes disposed on opposite sides of the axis and extending through the disk portion only, whereby the cord is attached to the weight by inserting each end of the cord down through an inner hole and then looping said end upward through an adjacent outer hole, thereby creating a loop, and thereafter back down and through the loop.

4. The device of claim 3, further comprising an arcuate cord guard, being a segment of tubing inserted through the eyelet and arched on either side thereof and adopted to extend part way toward the golf club head, encompassing and protecting the cord.

5. The device of claim 3, further comprising a linear cord guard, being a straight segment of tubing for placement adjacent a forward surface of the shaft and adopted to extend from near the eyelet to a mid portion of the shaft, wherein the first and second ends of the cord are drawn therethrough and attached to the weight.

6. The device of claim 4 or 5, wherein the weight is made of composition rubber.

7. The device of claim 6 for use by children, wherein the weight weighs 3 to 5 ounces.

8. The device of claim 6 for use by women, wherein the weight weighs 5 to 8 ounces.

9. The device of claim 6 wherein the weight has a plurality of holes in an upper surface of the disk portion for receiving and storing golf tees.

10. The device of claim 6 for use by men, wherein the weight weighs 6 to 16 ounces.

* * * * *